US008313182B2

(12) United States Patent
Jones et al.

(10) Patent No.: US 8,313,182 B2
(45) Date of Patent: Nov. 20, 2012

(54) INK LOADER WITH INK STICK RETRACTOR

(75) Inventors: Brent Rodney Jones, Sherwood, OR (US); Frederick T. Mattern, Portland, OR (US); Richard G. Chambers, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 107 days.

(21) Appl. No.: 12/898,804

(22) Filed: Oct. 6, 2010

(65) Prior Publication Data

US 2012/0086760 A1 Apr. 12, 2012

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS 5,861,903 A 1/1999 Crawford et al.
5,975,690 A * 11/1999 Grellmann et al. ..... 347/88
7,425,061 B2 9/2008 Korn et al.
7,533,977 B2 * 5/2009 Park ..... 347/88
7,726,798 B2 6/2010 Mattern et al.
7,819,513 B2 * 10/2010 Fairchild ..... 347/88
2008/0218548 A1 * 9/2008 Fairchild et al. ..... 347/14

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A solid ink loading system for a phase change ink imaging device includes an ink loader having a first end, a second end, and at least one feed channel extending between the first and the second end. The at least one feed channel includes an insertion region intermediate the first and the second end where ink sticks enter the at least one feed channel. The at least one feed channel is configured to guide ink sticks in a feed direction from the insertion region toward the second end. An ink stick retractor is configured for movement between a forward position and a rearward position substantially parallel to at least a portion of the at least one feed channel. The forward position is closer to the second end of the feed channel than the first position. The ink stick retractor is configured to selectively move ink sticks in the at least one feed channel in a retraction direction toward the first end.

19 Claims, 6 Drawing Sheets

INK LOADER WITH INK STICK RETRACTOR

TECHNICAL FIELD

This disclosure relates generally to phase change ink printers, and in particular to solid ink loaders for use in such printers.

BACKGROUND

Phase change ink imaging products encompass a wide variety of imaging devices, such as ink jet printers, facsimile machines, copiers, and the like, that are configured to utilize phase change ink to form images on recording media. Some of these devices use phase change ink in a solid form, referred to as solid ink sticks. Imaging devices that utilize solid ink sticks are typically provided with feed channels. Ink sticks are inserted into the feed channels through insertion openings and then urged by one or more drive members, gravity, or a combination thereof in a feed direction toward melting devices located at one end (i.e., the melt ends) of the channels where the ink sticks are melted to a liquid ink suitable for jetting onto recording media.

Each feed channel has an insertion area or region where ink sticks are received after passing through the corresponding insertion opening. To enable insertion of ink sticks into the feed channels, drive members, such as push blocks, are retracted to a rearward position beyond the insertion regions of the channels to provide clearance for ink sticks to be inserted into the insertion regions of the feed channels in front of the push blocks. After ink stick insertion has been completed, the push blocks are moved from the retracted position to apply an urging force to the trailing end of the last ink stick inserted into the channels. If there is space in front of the last ink stick, the urging force causes the ink stick to move forward in the channel until the ink stick abuts the trailing end of the previously inserted ink stick or moves forward until the ink stick impinges on the melting device located at the melt end of the channel if no other ink sticks are in the channel.

If the column of ink in a channel extends far enough from the melt end of the channel toward the insertion region, the next ink stick inserted into the channel may still protrude into the insertion region of the channel after being abutted against the trailing end of the column, preventing ink sticks from being inserted into the channel, at least temporarily. The position of the insertion opening relative to the melt end of a channel therefore controls the number of ink sticks capable of being loaded into the channel at any given time in these systems. Consequently, the insertion openings of the channels are typically located as far away from the melt ends of the channels as possible to maximize the number of ink sticks capable of being loaded into the channels.

In some imaging device configurations, however, the lengths of the feed channels may be limited because the area most distant from the melt ends of the channels may be inaccessible for ink stick insertion. Consequently, the insertion openings for the feed channels of the ink loader in these devices have to be located at a location that shortens the potential length of the feed channel. Thus, the number of ink sticks (and the amount of ink) that may otherwise be loaded into the channels is decreased. A similar situation exists if there is an opportunity to increase channel length and thus ink capacity.

SUMMARY

In accordance with the present disclosure, an ink stick retraction system has been developed for use in the ink loader of a phase change ink imaging device that enables feed channels to incorporate ink stick insertion openings that are positioned at intermediate locations of the feed channel by using an ink stick retraction system. In one embodiment, a solid ink loading system for a phase change ink imaging device includes an ink loader having a first end, a second end, and at least one feed channel extending between the first and the second end. The at least one feed channel includes an insertion region intermediate the first and the second end where ink sticks enter the at least one feed channel. The at least one feed channel is configured to guide ink sticks in a feed direction from the insertion region toward the second end. An ink stick retractor is configured for movement between a forward position and a rearward position substantially parallel to at least a portion of the at least one feed channel. The forward position is closer to the second end of the feed channel than the first position. The ink stick retractor is configured to selectively move ink sticks in the at least one feed channel in a retraction direction toward the first end.

A solid ink loading system for a phase change ink imaging device includes an ink loader having a first end, a second end, and at least one feed channel extending between the first and the second end. The at least one feed channel includes an insertion region intermediate the first and the second end where ink sticks enter the at least one feed channel. The at least one feed channel is configured to guide ink sticks in a feed direction from the insertion region toward the second end. The solid ink loading system includes an ink feed system configured to move ink sticks in the feed direction from the insertion region toward the second end; and an ink stick retractor configured to move ink sticks in the retraction direction from the insertion region toward the first end.

DETAILED DESCRIPTION

Figure 1:
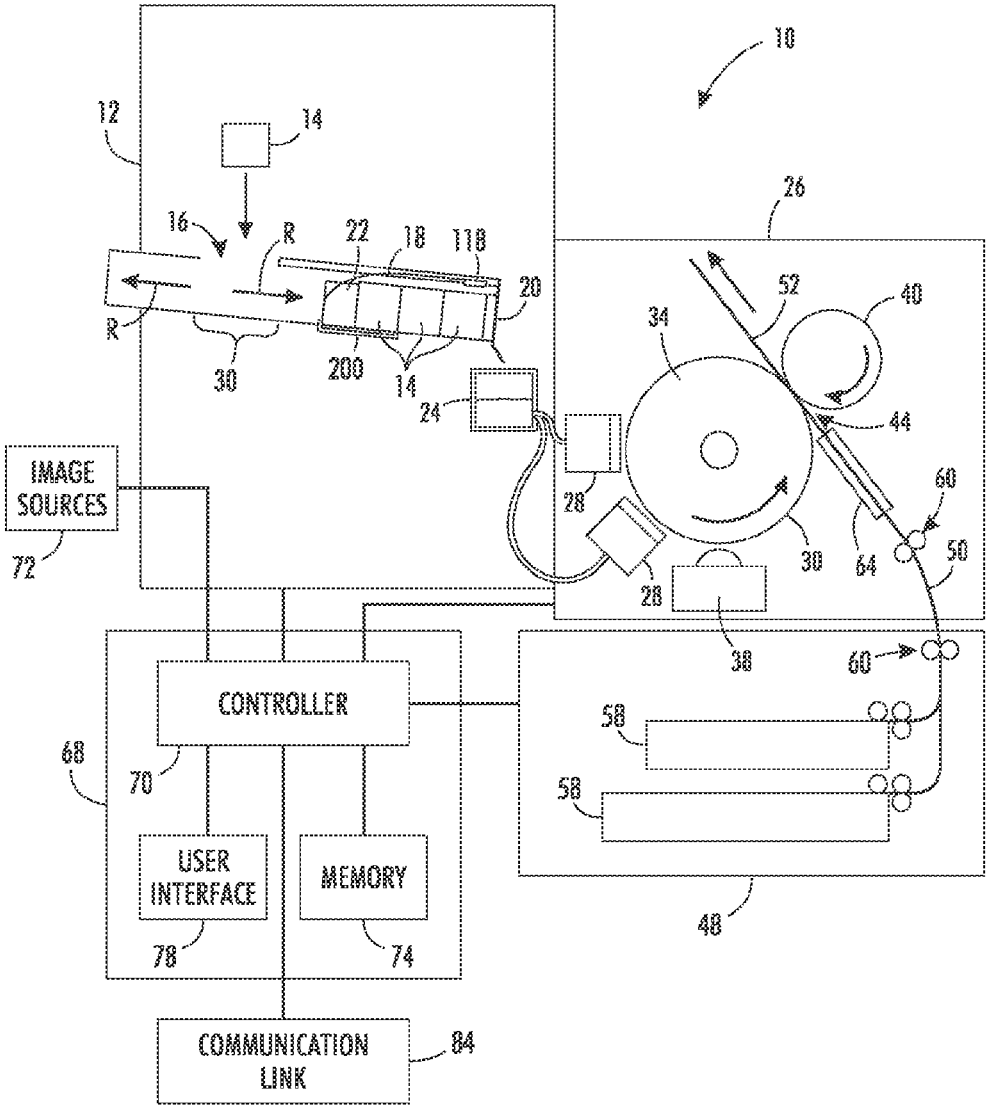
FIG. 1 is a schematic view of a phase change ink imaging device.

For a general understanding of the present embodiments, reference is made to the drawings. In the drawings, like reference numerals have been used throughout to designate like elements.

FIG. 1 is a side schematic view of an exemplary embodiment of a phase change ink imaging device 10 configured to receive phase change ink in solid form and to melt the solid ink to a liquid for jetting onto an ink receiving surface. The device 10 of FIG. 1 includes an ink handling system 12, also referred to as an ink loader, that is configured to receive phase change ink in its solid form as blocks of ink 14, referred to as solid ink sticks. The ink loader 12 includes feed channels 18 into which ink sticks 14 are inserted. Although a single feed channel 18 is visible in FIG. 1, the ink loader 12 includes a separate feed channel for each color or shade of ink stick 14 used in the device 10.

Ink sticks 14 are inserted into an insertion region 30 of the feed channels through insertion openings 16. The insertion region of a feed channel refers to the portion of the guide path of the feed channel where an ink stick comes to rest upon entry into the channel. In the embodiment of FIG. 1, the insertion openings 16 are positioned above the channels 18 so the insertion rest region 30 of the channel 18 corresponds to the portion of the channel 18 located substantially below the opening 16. In alternative embodiments, ink sticks may be inserted into the channels through an opening in the side of the channels or the ends of the channels.

After an ink stick 14 has been inserted into the channel, the ink stick is moved in a feed direction F toward the melting assembly 20 at the end of the channel 18 by a mechanized delivery system and/or by gravity until the ink stick 14 abuts against the trailing end of a previously inserted ink stick or impinges on a melting device, such as a melt plate, at the melting assembly 20 if no other ink sticks are in the channel 18. In the embodiment of FIG. 1, the delivery system comprises a spring loaded push block 22 configured to push, or urge, ink sticks 14 toward the melting assembly 20. If multiple ink sticks are loaded into the channel 18, the push block 22 urges the ink sticks against each other in the channel 18 to form a substantially continuous column of solid ink that extends from a melting assembly 20 of the channel 18 to the push block 22.

The push block 22 is retracted in a direction opposite the feed direction F (i.e., a retraction direction R) toward the opposite end of the channel 18 from the melt assembly 20 to enable ink sticks to be inserted into the insertion region 30 of the channel in front of the push block 22. As explained below, the feed channels 18 of the ink loader 12 are provided with an ink stick retraction system 200 configured to move one or more ink sticks 14 located at the trailing end of the column of ink in each channel in the retraction direction R to provide a clear space in the feed channel for the insertion region 30. The ability to retract ink sticks enables the insertion regions of the channels to be located at an intermediate location of the feed channel without decreasing or limiting the number of ink sticks that may be loaded into the channel.

The feed channel 18 guides the column of ink sticks 14 toward the melting assembly 20 at one end of the channel 18 where the sticks are heated to a phase change ink melting temperature to melt the solid ink to form a molten liquid ink, also referred to as melted ink. Any suitable melting temperature may be used depending on the phase change ink formulation. In one embodiment, the phase change ink melting temperature is approximately 80° C. to 130° C. The melted ink is received in a reservoir 24 configured to maintain a quantity of the melted ink in molten form for delivery to printing system 26 of the device 10.

The printing system 26 includes at least one printhead 28 having inkjets arranged to eject drops of melted ink onto an ink receiving surface. Any suitable number of printheads 28 may be used. Each printhead may be configured with reservoir 24 or may be in fluid communication with reservoir 24. The device 10 of FIG. 1 is configured to use an indirect printing process in which the drops of ink are ejected onto an intermediate surface 32 and then transferred to recording media, such as paper, transparency, and the like. In alternative embodiments, the device 10 may be configured to eject the drops of ink directly onto recording media. A layer or film of release agent is applied to a rotating member 34 by the release agent application assembly 38 to facilitate the transfer of ink images from the surface 32 of member 34 to the recording media. The rotating member 34 is shown as a drum in FIG. 1 although in alternative embodiments member 34 may comprise a rotating roller, moving belt or band or other similar type of structure. A nip roller 40 is loaded against the intermediate surface 32 on rotating member 34 to form a nip 44 through which sheets of recording media 52 are fed in timed registration with the ink drops deposited onto the intermediate surface 32 by the inkjets of the printhead 28. Pressure (and in some cases heat) is generated in the nip 44 that, in conjunction with the release agent that forms the intermediate surface 32, facilitates the transfer of the ink drops from the surface 32 to the recording media 52 while substantially preventing the ink from adhering to the rotating member 34.

The imaging device 10 includes a media supply and handling system 48 that is configured to transport recording media along a media path 50 defined in the device 10 that guides media through the nip 44, where the ink is transferred from the intermediate surface 32 to the recording media 52. The media supply and handling system 48 includes at least one media source 58, such as supply tray 58 for storing and supplying recording media of different types and sizes for the device 10. The media supply and handling system includes suitable mechanisms, such as rollers 60, which may be driven or idle rollers, as well as baffles, deflectors, and the like, for transporting media along the media path 50.

Media conditioning devices may be positioned along the media path 50 for controlling and regulating the temperature of the recording media so that the media arrives at the nip 44 at a suitable temperature to receive the ink from the intermediate surface 32. For example, in the embodiment of FIG. 1, a preheating assembly 64 is provided along the media path 50 for bringing the recording media to an initial predetermined temperature prior to reaching the nip 44. The preheating assembly 64 may rely on contact, radiant, conductive, or convective heat, or any combination, to bring the media to a target preheat temperature, which in one practical embodiment, is in a range of about 30° C. to about 70° C. In alternative embodiments, other thermal conditioning devices may be used along the media path before, during, and after ink has been deposited onto the media for controlling media (and ink) temperatures and/or moisture content.

Operation and control of the various subsystems, components and functions of the imaging device 10 are performed with the aid of a control system 68. The control system 68 is operably coupled to receive and manage image data from one or more image sources 72, such as a scanner system or a work station connection, and to generate control signals that correspond to the image data. These signals cause the components and systems to perform the various procedures and operations for the imaging device 10. The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or microcontroller, configured to execute instructions stored in the memory 74. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 may include a keypad, buttons, or other similar types of manual actuators (not shown), and a display (not shown). The controller 70 is operably coupled to user interface 78 to receive signals indicative of selections and other information input to the user interface 78 by a user or operator of the device. Controller 70 is operably coupled to the user interface 78 to display information to a user or operator including selectable options, machine status, consumable status, and the like. The controller 70 may also be coupled to a communication link 84, such as a computer network, for receiving image data and user interaction data from remote locations.

The controller 70 is operably coupled to the various systems and components of the device 10, such as the ink handling system 12, printing system 26, media handing system 48, release agent application assembly 38, media conditioning devices, and other devices and mechanisms of the imaging device 10, and is configured to generate control signals that are output to these systems and devices in accordance with the print data and instructions stored in memory 74. The control signals, for example, control the operating speeds, power levels, timing, actuation, and other parameters, of the system components to cause the imaging device 10 to operate in various states, modes, or levels of operation, referred to collectively herein as operating modes.

Figure 2A:
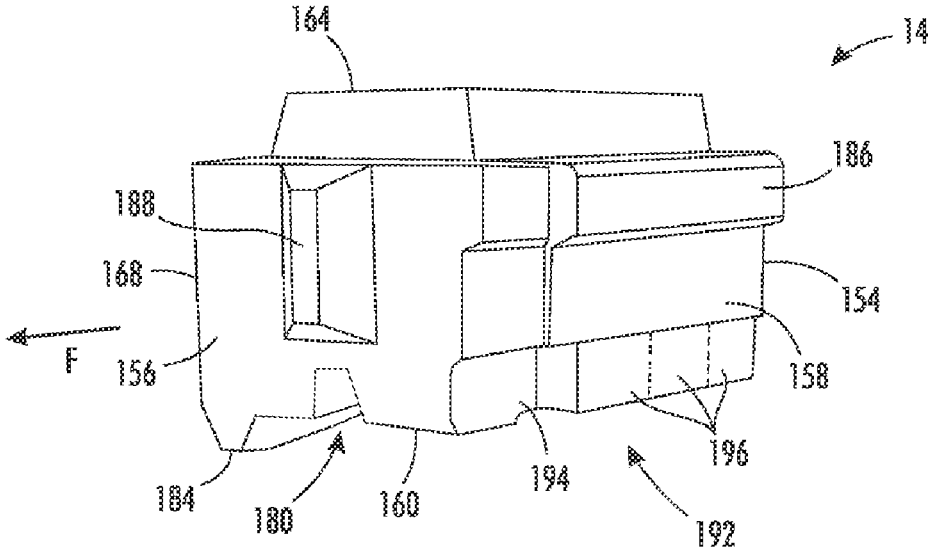
FIG. 2A is a perspective view of a leading end of an solid ink stick for use with a phase change ink imaging device, such as the device of FIG. 1.
Figure 2B:
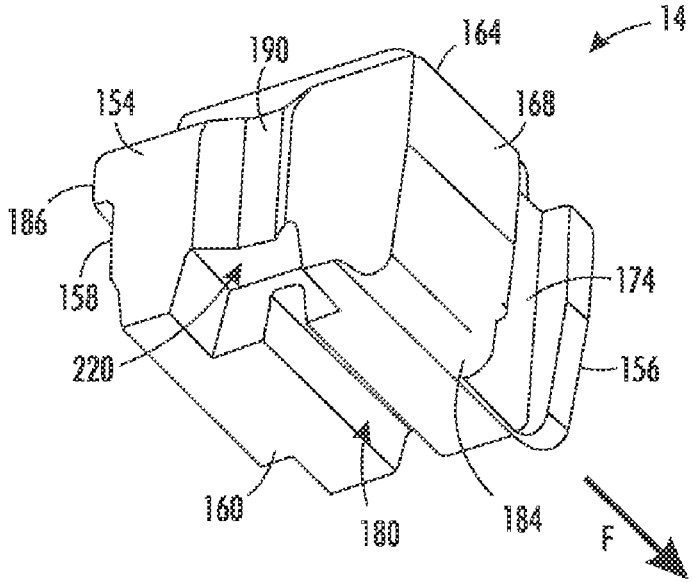
FIG. 2B is a perspective view of the trailing end and bottom surface of the solid ink stick of FIG. 2A.

As depicted in FIGS. 2A and 2B, a solid ink stick 14 comprises a body formed of a solidified phase change ink material and shaped using a suitable fabrication process, such as casting, pour molding, injection molding, compression molding, or other known techniques. The body of the ink stick 14 includes end surfaces 154, 156, and lateral surfaces 158, 160, 164, 168. The lateral surfaces 158, 160, 164, 168 of the ink stick 14 are configured for arrangement generally parallel to the direction of ink stick travel in a feed channel, referred to herein as the feed direction F. The lateral surfaces include a bottom surface 160 configured for arrangement adjacent to the base or floor of a feed channel 18, a top surface 164 opposite the bottom surface, and a pair of side surfaces 158, 168 that extend between the top and bottom surfaces 164, 160. The end surfaces 154, 156 are configured for arrangement generally perpendicular to the feed direction F with one of the ends 156 facing in the feed direction F and serving as the leading end of the ink stick, and the other end surface 154 facing opposite the feed direction F and serving as the trailing end of the ink stick. Though ink sticks for different models may differ considerably in appearance or size, the ink stick 14 of FIGS. 2A and 2B is representative of the feature types that may be present on other ink sticks.

Ink sticks, such as ink stick 14, may include a number of surface features that aid in the correct loading, guidance, feed control and support of the ink stick when used. As used herein, the term "surface features" and "features" used in relation to and ink sticks refers to topological contours, such as protrusions, recesses, grooves, and the like, that are sized, shaped, and/or otherwise configured to interact in some manner with one or more elements, devices, and members of an ink loader, or feed channel, such as key elements, guides, supports, sensors, etc. For example, the ink stick 14 includes insertion key feature 174 (FIG. 2B) that comprises a groove or notch formed in side surface 168 extending generally between the top surface 164 and the bottom surface 160. The insertion opening 16 in the ink loader is provided with a perimeter (not shown) shaped complementarily with respect to the perimeter shape of the ink stick 14.

An ink stick may also include feed control and guidance features for interacting with various structures provided in the feed channel. For example, ink stick 14 includes a feed key groove 180 formed in the bottom surface 160 extending from the leading end surface 156 to the trailing end surface 154. The feed key groove 180 is configured to straddle a feed key (not shown) that extends from the feed channel. In alternative embodiments, the ink stick 14 may be provided with any suitable type of feed key feature for interacting in any manner with whatever type of keying, guidance or support members are provided in a feed channel. In addition, the ink stick 14 includes guide feature 184 near the bottom of side surface 168 and guide feature 186 near the top of side surface 158 for interacting with complementary structures in the feed channel to facilitate alignment of ink sticks in the channel and to limit contact between ink sticks and the feed channel structural elements, such as ribs, supports and other potentially restrictive surfaces. The typical ink loader in a desk top printer or MFP has generally been configured with linear feed channels. Various imaging products, including those of larger size, may have feed channels that are fully or partially non linear or any shape suited to the needs and available space in the product.

An ink stick may also include nesting features to facilitate alignment and feed guidance of the ink sticks in the feed channels. As depicted in FIGS. 2A and 2B, the ink stick 14 includes nesting features 188, 190 at the leading end 156 and trailing end 154, respectively, of the ink stick. The nesting features 188, 190 are shaped complementary with respect to each other which facilitates alignment between adjacent ink sticks while maximizing load density in the feed channel. In use, when an ink stick having a nesting feature 188 in the leading surface 156 abuts an ink stick in the feed channel having complementary nesting feature 190 in the trailing surface 154, the protruding nesting feature of one ink stick is received in the recessed nesting feature of the subsequent stick. The nesting features of the adjacent sticks cooperate to limit lateral movement of the sticks with respect to each other thereby promoting alignment of the sticks in the channel. Nesting features may not be present and if end insets and protrusions are incorporated, they need not be of a matching shape.

In addition to or as an alternative to the insertion, feed guidance, and nesting features, ink sticks may be provided with sensor features for conveying ink stick data to the print controller of the solid ink printer. The ink stick data encoded onto an ink stick may include identification information, such as color, formulation, and intended printer model, as well as printing information, such as printer settings or preferences for use with the ink stick. Sensor features comprise surface formations on the ink stick body that are configured to interact with sensors positioned at one or more locations in the insertion region and/or other portions of feed channels to convey ink stick data to the print controller of a solid ink printer.

Sensor features may have any suitable configuration that permits reliable sensor interaction, such as protrusions, recesses, reflective features, non-reflective features, and the like, depending on the type of sensor used. In the embodiment of FIG. 2, the ink stick 14 includes a sensor feature 192 that comprises one or more contiguous insets 194 arrayed in the feed direction F in a lower portion of the side surface 170. A single inset 196 is shown in FIG. 2. The locations 196 shown as dotted lines represent other positions where insets may be placed in the exemplary embodiment.

Ink stick data may be encoded into an ink stick by assigning data to the sensor feature 192. To extract the data from the sensor feature 192, the feed channel 18 is provided with a sensor system (not shown) capable of sensing, detecting, or being actuated by the recesses 194 of the sensor feature 192. The sensor feature 192 actuates the sensors of the sensor system causing the sensor system to output signals to the printer controller 70 indicative of the data assigned to the sensor feature 192. The controller 70 may then use the data to influence operations of the printer. For example, in one embodiment, once the ink stick data has been identified, the controller 70 may determine whether or not the ink stick is compatible with the printer and enable or disable operations accordingly.

Figure 3:
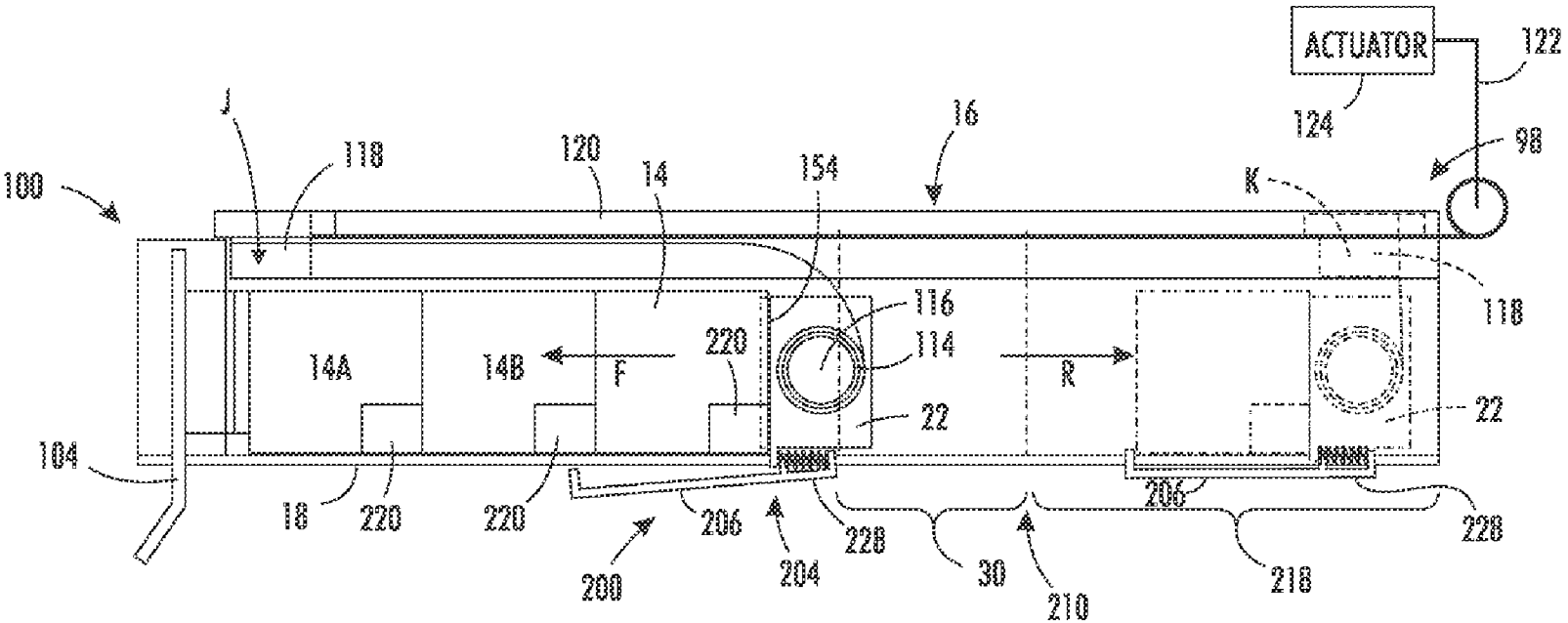
FIG. 3 depicts an embodiment of an ink stick retraction system for use in the ink loader of the imaging device of FIG. 1 in which the ink stick retractor is integrated with a push block of the ink loader.

FIG. 3 depicts a side cross-sectional view of a feed channel 18 in greater detail. As shown, the feed channel 18 comprises a longitudinal chute or similar type of structure having a first end 98 and a second end 100. A melting device 104 in the form of a melt plate is located at the second end 100, also referred to as the melt end, of the channel 18. The longitudinal portion of the channel extends between the first end 98 and the second end 100. An insertion area or region 30 is located at a suitable location between the first end 98 and second end 100 of the channel proximate the insertion opening 16. The term longitudinal, as applicable to an ink loader, refers to its lengthwise shape complementary to feed direction rather than widthwise in a direction across feed channels. The longitudinal portions of the feed channels may be straight, horizontal, vertical, sloped, arcuate or any combination thereof.

Each feed channel includes a feed mechanism for urging ink sticks that have been inserted into the channels toward the melting device 104 located at the melt end 100 of the channel. In the embodiment of FIG. 3, the feed mechanism comprises a push block 22 that is configured for translational movement in the feed channel 18 between an urging position and at least one retracted position. As used herein, the term "push block" refers to any type of structure or mechanism capable of applying a motive or urging force to the ink sticks in the channel to cause the ink sticks to move in the feed direction F of the channel. To provide the motive or urging force, the push block 22 is operatively connected to a drive system configured to move the push block 22 between an urging position and at least one retracted position. In the urging position, the push block 22 is moved into contact with a trailing end surface 154 of the column of ink sticks 14 in the feed channel by the drive system to apply a suitable force to the trailing end of the column of ink sticks to urge the ink sticks in the feed direction F so that the leading ink stick of the column impinges on the melt plate 104. In the urging position, the push block 22 continues to apply the urging force to the column of ink as the leading ink stick is melted so that the next ink stick in the column is moved into contact with the melt plate 104 when the leading ink stick is completely melted. The melt device has been described as being associated with the ink loader such that only molten ink would be exiting the loader after being melted during normal operation. The melt end of the ink loader feed channel typically includes a melting assembly but the melt function may be a device not integrated with the ink loader. Descriptions of or similar to "melt end" are applicable to the ink loader and/or feed direction even when the melting means is independent or implemented in an arrangement other than as depicted in FIG. 3 and otherwise described herein. One alternative example to the present configuration is a loader where the ink exit end is configured to direct solidified ink forms, which may be a small size, to another device where it would be melted, one example being a melt reservoir of a printhead.

In the embodiment of FIG. 3, the urging force is provided by a constant force spring 114 which is wound at one end as a freely rotatable coil housed within the push block 22. The coil may be wound about a hub 116. The other end of the spring 114 is attached to a yoke 118. The yoke 118 is configured to move adjacent to the feed channel 18 between a forward position J proximate the melt end 100 of the feed channel 18 and a rearward position K proximate the first end 98 of the feed channel. The yoke 118 may be supported for movement between the forward and rearward positions in any suitable manner. For example, in the embodiment of FIG. 3, the yoke 118 is configured to cooperate with a guide slot and/or guide rail 120 arranged adjacent to the feed channel 18 to enable translational movement of the yoke 118 between the forward and rearward positions J,K, respectively. Yoke 118 motion is the push block 22 driver and the position of the push block is complementary to yoke position. The Yoke 118 influences the position of the push block 22 within the limits of its range of motion relative to spring loading influence and the presence of ink sticks within the feed channel. The reason for this will become apparent in the following description of push block functionality.

When the yoke 118 is in the forward position J, the constant force spring 114 pulls the push block 22 toward the melt end 100 of the channel to a location proximate the yoke 118. If ink sticks are positioned in the feed channel 18 in front of the push block 22, the pulling force of spring 114 on the push block 22 causes the push block 22 to move into contact with the trailing end of the ink sticks in the channel and urge the ink sticks toward the melt end 100 of the channel 18. The spring 114 is coupled to the hub of the push block 22 in a manner that enables the spring body to extend between the yoke 118 and the push block 22 without interfering with ink stick movement in the feed channel. For example, as depicted in FIG. 3, the spring body extends along a path that is located above the feed path of ink sticks in the feed channel. In embodiments, the spring 114 may extend along a path to either lateral side of the feed channel or below the feed channel.

To enable the insertion of ink sticks into the channel 18, the push block 22 is moved toward the insertion end 98 of the feed channel to a retracted position located beyond the insertion region 30 of the channel to enable ink sticks to be inserted into the feed channel in front of the push block (relative to the feed direction F). To move the push block 22 to the retracted position, the yoke 118 is moved from the forward position J to the rearward position K. When the yoke 118 is in its rearward position, the spring 114 coils within the push block 22 enabling the push block 22 to be moved by the yoke in the retraction direction R to its retracted position in the feed channel.

The yoke 118 is coupled to an actuation system 124 that is configured to move the yoke 118 between the forward and rearward positions J, K to enable ink loading operations. Any suitable type of actuation system may be used including manually operated actuation, electro-mechanical actuation, or a combination thereof. For example, in one embodiment, the yoke is coupled by a suitable linkage to a manually operated access cover that controls access to the insertion openings 16 of the ink loader. When the access cover is opened, the linkage 122 retracts the yoke 118 to its rearward position K which in turn causes the push block 22 to be retracted toward the first end 98 of the feed channel. When the access cover is closed, the linkage moves the yoke 118 to its forward position J thereby moving the push block 22 forward in the channel 18 and into the urging position. As an alternative to manually controlling yoke 118 position, some devices may include a motorized actuation system 124 configured to control the position of the yoke 118 to enable ink loading operations. A motorized actuation system 124 may be activated in any suitable manner such as by input received from the user interface 78 and/or by control signals received from the device controller 70. In embodiments, the controller 70 may be configured to control the actuation system 124 to enable ink loading based on user input as well as other factors, such as device operating state.

During ink loading operations, if a previously loaded ink stick is located even partially in the insertion region 30 of the channel 18, the insertion of an ink stick into the channel may be prevented. For example, depending on the position of the insertion region 30 in the channel, when multiple ink sticks are loaded into a channel and abutted against each other to form a column of ink, the column of ink may extend from the melt end 100 of the channel a distance such that the trailing end of the column protrudes into the insertion region 30 of the channel. To enable ink stick insertion in circumstances such as this, the feed channel 18 may be equipped with an ink stick retraction system 200 in accordance with one embodiment of the present disclosure. The ink stick retraction system 200 is configured to transport or move one or more ink sticks in the retraction direction R along the feed channel to a position between the first end 98 of the feed channel and the insertion region 30 in order to clear the insertion region 30 of the channel 18 for ink loading. This function enables numerous ink loader configurations, including insertion openings intermediate the ends of the feed channel and ink insertion "drawers" that can be pulled out from the main ink loader body to replenish ink. To enable clearance of the insertion region 30 by the retraction system 200, the feed channel 18 includes a staging area or section 218 that extends between first end 98 of the channel and the trailing edge 210 of the insertion region that is sized to accommodate the desired number of retracted ink sticks and any push block or similar feed associated components.

Figure 4:
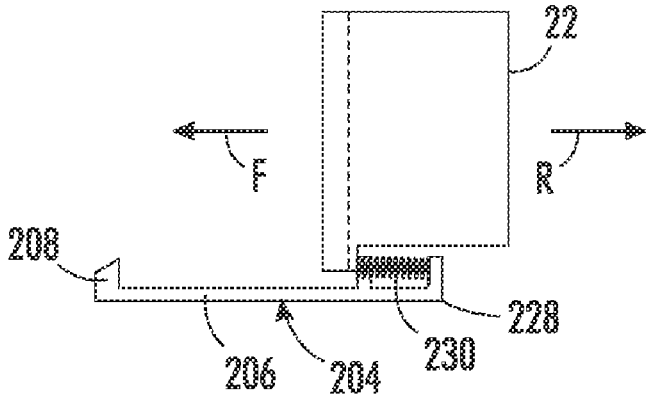
FIG. 4 depicts the ink stick retraction system of FIG. 3 with the retractor being moved in the retraction direction of the feed channel by the push block.

As depicted in FIG. 3, the ink stick retraction system 200 includes an ink stick retractor 204 supported in the channel for translational movement along the feed channel between a forward position located between the melt end 100 of the channel and the leading edge 214 of the insertion region and a rearward position located between the first end 98 of the channel and the trailing edge 210 of the insertion region. The ink stick retractor 204 includes an ink stick engaging portion 208 that is configured to engage a portion of an ink stick at least during movement of retractor 204 in the retraction direction R from generally in and just ahead of the insertion region. In the embodiment of FIGS. 3 and 4, the ink stick engaging portion is oriented at least partially perpendicular to the feed and retraction directions F, R in order to engage a portion of an ink stick 14 that faces generally toward the melt end 100 of the channel when the retractor 204 is moved in the retraction direction R. Ink sticks in the feed channel forward of the one or more ink sticks that can be pulled into a clearance area behind the insertion region are the only ink sticks that would be moved during retraction.

To facilitate reliable interaction between the ink stick engaging portion 208 of the retractor 204 and an ink stick 14 during retraction, ink sticks 14 may be provided with a motion control inset 220. As depicted in FIGS. 2A, 2B, 3 and 4, the motion control inset 220 comprises a recess or pocket formed in the bottom surface 160 of the ink stick 14. In the embodiment of FIGS. 2A and 2B, the inset 220 is positioned proximate the trailing end of the ink stick 14 extending through the trailing surface 154 although an inset 220 may be provided at any suitable location to facilitate retraction. When an ink stick having an inset is positioned adjacent to another ink stick in the feed channel, the inset 220 forms a clear space between sticks for the ink stick engaging portion 208 of the retractor 204 to engage the leading surface 156 of an ink stick. The retractor 204 fits into the clearance area between surface 156 and surface 224 of inset 220 when the retractor is moved in the retraction direction R. In alternate configurations, an inset or pocket similar to 220 may be positioned at the ink stick front surface or intermediate the front and rear surfaces. With respect to the retractor, the leading surface is the leading surface of an interface engagement surface that may or may not be at the front of the ink stick.

The ink stick retractor 204 is coupled to a drive system that enables the retractor 204 to be controllably moved between the forward and rearward positions. In the embodiment of FIG. 3, the ink stick retractor 204 is operatively connected to the push block 22 so that movement of the push block 22 controls the movement of the retractor 204. The retractor 204 has an extended main body 206 that is operatively connected to the push block at one end 210 with the ink stick engaging portion 208 extending from the other end of the main body. The main body 206 extends from the push block 22 generally in the feed direction F of the feed channel 18 at a location that is at least partially outside of the area of the feed channel occupied by ink sticks. In the embodiment of FIG. 3, the main body 206 of the retractor 204 is located substantially below the feed channel 18 although in alternative embodiments the main body 206 of the retractor 204 may extend along the lateral sides or above the occupied area of the feed channel.

The main body 206 positions the ink stick engaging portion 208 of the retractor 204 a suitable distance in front of the push block 22 to enable the ink stick engaging portion 208 to extend into the feed channel in front of at least a portion of an ink stick 14 located in front of the push block. The distance that the main body 206 extends from the push block 22 is selected based on the size and number of ink sticks that is required to be retracted in order to clear the insertion area 30 for a given feed channel configuration. Depending on the position of the insertion region 30 of the channel 18 relative to the ends 98, 100 of the channel, one or multiple ink sticks may have to be retracted in order to clear the insertion area.

The main body 206 of the retractor may be connected to the push block in a manner that enables the main body 206 and the ink stick engaging portion thereof to move between a lowered position in which the ink stick engaging portion is located outside of the feed path of the feed channel and an elevated position in which the ink stick engaging portion 208 is located in the feed path of the feed channel. In the embodiment of FIGS. 3 and 4, retractor 204 is connected to the push block in a manner that enables main body 206 of the retractor to flex or pivot with respect to the push block between lowered and elevated positions based on the direction of movement. In the exemplary embodiment, when the push block 22 is in the urging position, the ink stick engaging portion 208 of the retractor 204 is in the lowered position and spaced apart from the ink sticks 14 in the channel 18. Movement of the push block 22 in the retraction direction R may cause the retractor 204 to pivot with respect to the push block 22 which causes the ink stick engaging portion 208 to move into the elevated position to engage an ink stick 14 in the feed channel 18. Alternatively, the body 206 and engagement 208 of the retractor 204 may be configured to enable sufficient flexure to bend below and ride under an ink stick as the push block 22 is pulled forward in to contact. When the push block is fully against the one or more ink sticks being pushed, the retractor would rise to its nominal elevated position so that the engaging end 204 rises into the ink stick recess 220, where it is positioned to enable retraction.

Figure 5:
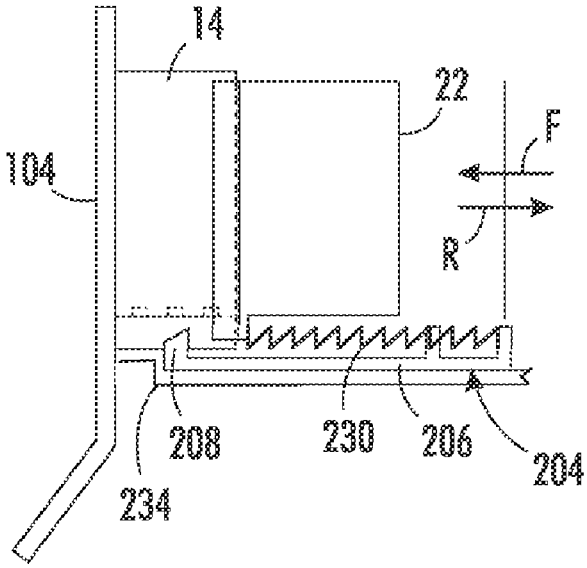
FIG. 5 depicts the push block and ink stick retractor of FIGS. 3 and 4 in greater detail when the push block is nearing the ink melt device.

In other embodiments, the retractor 204 may be slidably coupled to the push block 22 so that full forward motion toward the melt end of the channel 18 is enabled. In the exemplary embodiment shown in FIGS. 4 and 5, the retractor 204 is slidably connected to the push block 22 for translational movement with respect to the push block in directions that are generally parallel to the feed and retraction directions F, R of the feed channel. The connection end 228 of the retractor 204 extends rearwardly past the front face of the push block 22 and is connected to a rearward facing portion of the push block 22 by a biasing member, such as a spring 230. The spring biases the retractor in the feed direction F to enable the retraction of the desired number of ink sticks when the push block 22 and retractor 204 are moved in the retraction direction R. As depicted in FIG. 5, when the push block 22 approaches the melt end 100 of the channel 18, the retractor 204 is contacted by an obstructing surface 234 that prevents further movement of the retractor 204 in the feed direction F thus preventing the retractor 204 from contacting the melt plate 104. The biasing spring 230 enables the push block 22 to move with respect to the blocked retractor 204 and thus continue to move in the feed direction F and urge the ink stick 14 toward the melt plate 104.

Referring now to FIGS. 6*a*-6*d*, another embodiment of an ink stick retraction system 300 is shown. The retraction system 300 of FIGS. 6*a*-6*d* includes a retractor 304 that is operatively connected to the yoke 118 of the ink loader rather than to a push block 22. Similar to the embodiment of FIGS. 3-5, the retractor 304 includes an ink stick engaging portion 308 that is configured to engage a portion of an ink stick at least during movement of the retractor 304 in the retraction direction R. The yoke 118 is located substantially above the feed channel 18. The retractor 304 is pivotably connected to the yoke 118 to pivot between a clearance position (FIG. 6*d*) which in which the ink stick engaging portion 308 is spaced apart from the ink sticks in the channel and an engaged position (FIG. 6*b*) in which the ink stick engaging portion 308 is moved into the feed path to contact the surface of an ink stick in the feed channel (if present). As depicted, the retractor comprises a cantilever. In other embodiments, the retractor 304 may comprise a flexure or similar type of structure.

The retractor 304 is also configured to interact with a cam 310 that is configured to control the movement of the retractor 304 between the clearance and engaged positions based on the direction of movement and/or position of the yoke 118 relative to the feed channel. A spring 314, or other suitable biasing structure, is positioned between the retractor 304 and the yoke to bias the retractor 304 toward the clearance position and into an intermediate, or neutral, position to facilitate engagement with the cam 310.

Figure 6A:
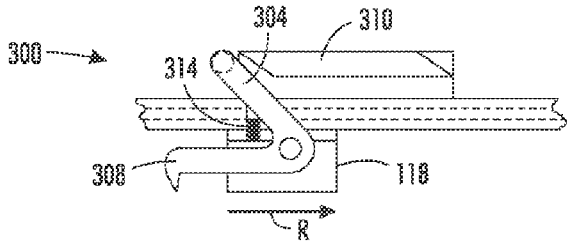
FIGS. 6A-6D depict an alternative embodiment of an ink stick retraction system for use in the ink loader of the imaging device of FIG. 1 in which the ink stick retractor is integrated with the yoke of the ink loader.
Figure 6B:
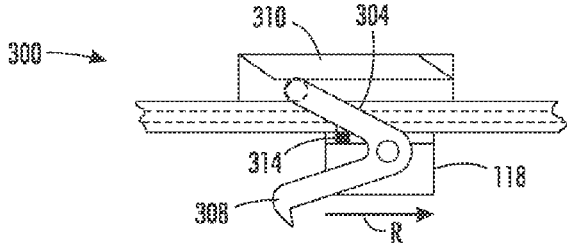
Figure 6C:
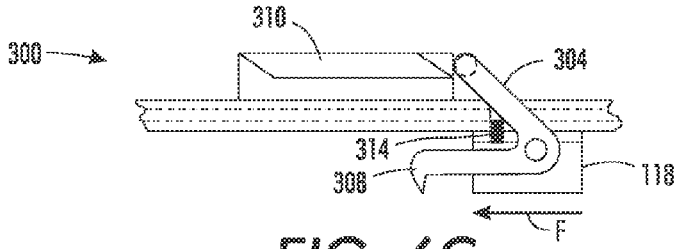
Figure 6D:
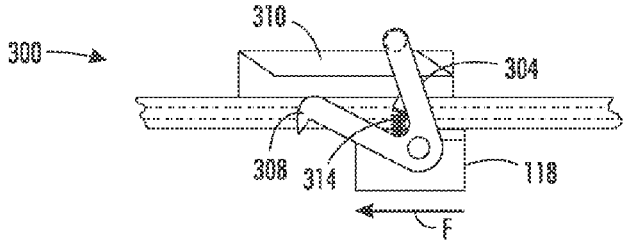

As depicted in FIG. 6*a*, as the yoke 118 is moved in the retraction direction R, the retractor 304 engages the cam 310 which causes the retractor 304 to pivot from the neutral position (FIG. 6*a*) toward the engaged position (FIG. 6*b*). In the engaged position, the ink stick engaging portion 308 is moved into the feed path and into contact with an ink stick 14. The retractor 304 pulls the engaged ink stick as the yoke 118 is moved in the retraction direction R. As depicted in FIG. 6*b*, movement of the retractor 304 to the engaged position compresses the spring 314. At a predetermined location along the feed channel 18, movement of the yoke 118 in the retraction direction causes the retractor 304 to move out of engagement with the cam 310 which allows the spring 314 to return the retractor 304 to the neutral position (FIG. 6*c*). As the yoke 118 is moved in the feed direction F, the retractor 304 engages the cam 310. The neutral position of the retractor 304 as it is moved in the feed direction enables the cam 310 to pivot the retractor 304 into the clearance position (FIG. 6*d*).

FIGS. 6*a*-6*d* depict one possible embodiment of a yoke mounted retractor. In alternative embodiments, a number of other suitable cam or cam track arrangements may be utilized. In addition, the retractor 304 may have a number of other configurations that enable the retractor to move ink sticks in the retraction direction with the movement of the yoke. The retractor 304 may comprise a flexure or cantilever or may be pivotally mounted to the yoke 118 so that the ink stick engaging portion 308 is located above the top surface of the ink sticks during movement of the yoke 118 in the feed direction F and is moved downwardly into the ink stick path of the feed channel 18 by a suitable feature, such as a cam or cam track interaction, to catch the top of an ink stick (not shown in FIG. 6) when the yoke 118 is moved in the retraction direction.

Figure 7A:
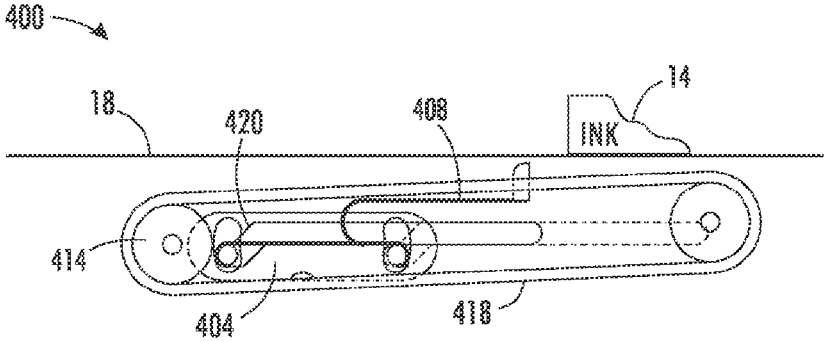
FIGS. 7A-7C depict another alternative embodiment of an ink stick retraction system for use in the ink loader of the imaging device of FIG. 1 in which the ink stick retractor is moved independently of the feed mechanisms of the ink loader.
Figure 7B:
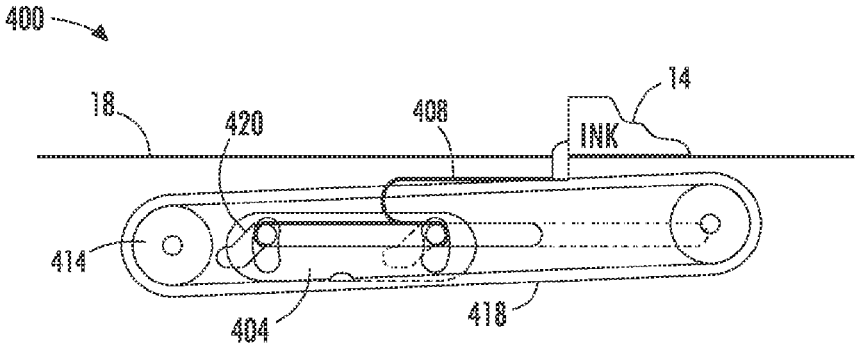
Figure 7C:
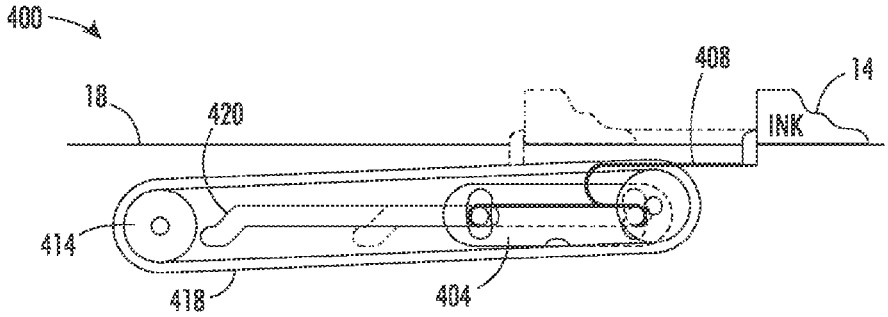

FIGS. 7*a*-7*c* depict an embodiment of an ink stick retraction system 400 that is configured for movement independent of the feed mechanisms of the ink loader 12. The system 400 includes a retractor 404 supported by a retractor drive system 410 that is configured to translate the retractor 404 between a forward position (FIG. 7*a*) and a rearward position (FIG. 7*c*) along the feed channel in the area of the insertion region 30. The retractor 404 includes an ink stick engaging portion 408 that is moved into the feed channel to push, pull, or otherwise move ink sticks in the retraction direction R as the retractor 404 is driven from the forward position to the rearward position. Any suitable type of drive system may be used including electro-mechanical, pneumatic, hydraulic, linear motors, piezo motors and so forth.

In the embodiment of FIG. 7, the drive system 410 comprises an electric motor 412 connected with or without a gear reduction to a drive wheel 414 acting on a looped drive belt 418. The drive belt 418 operates a cam influenced translation system 420 to which the retractor 404, in the form of a carriage or similar type of structure, is operatively connected. The cam system 420 causes the retractor 404 to translate in generally the feed and retraction directions F, R of the feed channel 18. The retractor 404 includes an ink stick engaging member 408 comprising a cantilever spring arm that is held below the ink sticks in the feed channel when the retractor is in the forward position. When the drive system 410 is actuated for retraction, the cam system causes the retractor 404 to translate in the retraction direction R and simultaneously lift the ink stick engaging portion into the feed channel to engage and push any sick present in the insertion region 30 toward the first end 98 of the feed channel. The drive system 410 of the retraction system 400 of FIG. 7 may be actuated based on controller 70 influence so that the retraction operation takes place at the proper time in an ink loader load access cycle. In addition, a separate retraction system 400 may be provided for each feed channel 18 so that ink retraction and ink loading may occur independently for each color of ink. Many other mechanisms independent of the yoke or push block are possible, as example, smaller Ink stick sizes may allow a solenoid driven retractor actuation.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those of ordinary skill in the art, which are also intended to be encompassed by the following claims.

What is claimed is:

1. A solid ink loading system for a phase change ink imaging device, the system comprising:

an ink loader having a first end, a second end, and at least one feed channel extending between the first end and the second end, the at least one feed channel including an insertion region intermediate the first and the second ends of the ink loader where solid ink sticks enter the at least one feed channel, the at least one feed channel being configured to guide solid ink sticks in a feed direction from the insertion region toward the second end; and an ink stick retractor having an ink stick engaging portion configured to contact a leading surface of at least one solid ink stick in the at least one feed channel, the leading surface facing the second end of the feed channel, and the ink stick retractor being configured for movement between a forward position and a rearward position substantially parallel to at least a portion of the at least one feed channel, the forward position being closer to the second end of the feed channel than to the first end, the ink stick retractor being configured to selectively move solid ink sticks in the at least one feed channel in a retraction direction toward the first end of the ink loader.

2. The system of claim 1 further comprising:

an ink feed system configured to move solid ink sticks in the feed direction toward the second end in the at least one feed channel.

3. The system of claim 2, the ink feed system comprising:

a push block supported in the at least one feed channel and configured for movement between the first end and the second end in both the feed direction and the retraction direction, the push block being configured to engage a trailing surface of a solid ink stick in the at least one feed channel to move the solid ink stick in the feed direction toward the second end, the trailing surface facing substantially toward the first end; and a push block translation driver supported proximate the at least one feed channel and configured for movement between the first end and the second end of the ink loader, the push block translation driver being operatively connected to the push block to translate the push block with respect to a current position of the push block translation driver in relation to the ink loader.

4. The system of claim 3 wherein the ink stick retractor is operatively connected to the push block to enable movement of the ink stick retractor with the push block, the ink stick engaging portion of the ink stick retractor being configured to move between the forward position and the rearward position in response to movement of the push block.

5. The system of claim 4 wherein the ink stick engaging member being slidably supported by the push block to enable movement of the ink stick engaging member between an extended position at which the ink stick engaging member is a first distance from the push block to a non-extended position at which the ink stick engaging member is a second distance from the push block, the second distance being less than the first distance; and the system further comprising:

a biasing member configured to bias the ink stick engaging member into the extended position and to enable the ink stick engaging member to move toward the non-extended position in response to the ink stick engaging portion contacting a portion of the feed channel proximate the second end.

6. The system of claim 5 wherein the ink stick engaging member is supported by a main body of the ink stick retractor in the extended position.

7. The system of claim 3 wherein the ink stick retractor is operatively connected to the push block translation driver to enable movement of the ink stick retractor with the push block translation driver.

8. The system of claim 7 wherein the ink stick engaging portion is configured to move from a first position spaced apart from solid ink sticks in the at least one feed channel to a second position in which the ink stick engaging portion extends into a portion of the at least one feed channel to engage the leading surface of a solid ink stick in the feed channel in response to the push block translation driver moving in the retraction direction.

9. The system of claim 3 further comprising:

a retractor drive system operatively connected to the ink stick retractor and configured to move the ink stick retractor independently of movement of components of the ink feed system.

10. The system of claim 9 wherein the ink stick engaging portion is supported by a main body of the ink stick retractor.

11. The system of claim 9 wherein the retractor drive system is configured to move the ink stick engaging portion from a clear position spaced apart from solid ink sticks in the at least one feed channel to a contact position in which the ink stick engaging portion extends into the at least one feed channel to engage the leading surface of a solid ink stick in the feed channel.

12. The system of claim 11 further comprising:

a controller operative connected to the retractor drive system and configured to control movement of the ink stick retractor.

13. The system of claim 12, the controller being further configured to determine an operating state of the phase change ink imaging device and to control the movement of the ink stick retractor with reference to the determined operating state.

14. The system of claim 1, the at least one feed channel including a staging section located between the first end and the insertion region, the ink stick retractor being configured to move ink sticks in the retraction direction out of the insertion region and into the staging section.

15. A solid ink loading system for a phase change ink imaging device, the system comprising:

an ink loader having a first end, a second end, and at least one feed channel extending between the first and the second end, the at least one feed channel including an insertion region intermediate the first and the second ends of the ink loader where solid ink sticks enter the at least one feed channel, the at least one feed channel being configured to guide solid ink sticks in a feed direction from the insertion region toward the second end;

an ink feed system configured to move solid ink sticks in the feed direction from the insertion region toward the second end; and an ink stick retractor configured to move solid ink sticks in a retraction direction from the insertion region toward the first end.

16. The system of claim 15, the at least one feed channel including:

a retraction region intermediate the insertion region and the first end of the ink loader, the ink stick retractor being configured to engage a leading surface of a solid ink stick in the at least one feed channel during movement of the ink stick retractor in the retraction direction.

17. The system of claim 15, the ink stick feed system further comprising:

a push block supported in the at least one feed channel and configured for movement between an urging position in which the push block engages a trailing surface of a solid ink stick in the at least one feed channel to urge the solid ink stick in the feed direction and a retracted position in which the push block is moved in the retraction direction to a position proximate the first end of the ink loader; and a push block translation driver supported proximate the at least one feed channel and configured for movement between the first end and the second end of the ink loader, the push block translation driver being operatively connected to the push block to move the push block between the urging position and the retracted position based on a position of the push block translation driver in relation to the ink loader.

18. The system of claim 17 wherein the ink stick retractor is supported by one of the push block and the push block translation driver to enable movement of the ink stick retractor with the push block or push block translation driver supporting the ink stick retractor.

19. The system of claim 17 wherein the ink stick retractor includes a retractor drive system configured to move the ink stick retractor in the retraction direction independently of the push block and push block translation driver.

* * * * *